US006401303B1

(12) United States Patent
Göhler et al.

(10) Patent No.: US 6,401,303 B1
(45) Date of Patent: Jun. 11, 2002

(54) FLEECE FUNNEL

(75) Inventors: Wolfgang Göhler, Lenting (DE); Lars Weisigk, Winterthur (CH)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/664,104

(22) Filed: Sep. 19, 2000

(30) Foreign Application Priority Data

Sep. 22, 1999 (DE) ..... 199 45 319

(51) Int. Cl.[7] ..... D01G 25/00
(52) U.S. Cl. ..... 19/150; 19/157
(58) Field of Search ..... 19/150, 157, 236, 19/288, 291, 292

(56) References Cited

U.S. PATENT DOCUMENTS 4,372,010 A * 2/1983 Gauvain ..... 19/288
4,763,387 A * 8/1988 Bothner ..... 19/288
5,666,698 A * 9/1997 Nauthe et al. ..... 19/157
5,689,856 A * 11/1997 Nauthe et al. ..... 19/157
5,761,773 A 6/1998 Nauthe et al.
5,815,887 A * 10/1998 Nauthe et al. ..... 19/150
6,151,760 A * 11/2000 Weber ..... 19/157

FOREIGN PATENT DOCUMENTS

DE 19535297 10/1996

OTHER PUBLICATIONS

German Search Report dated Jan. 12, 2000.

* cited by examiner

*Primary Examiner*—John J. Calvert
*Assistant Examiner*—Gary L. Welch
(74) *Attorney, Agent, or Firm*—Dority & Manning

(57) ABSTRACT

A fleece funnel is provided which is placed at a predetermined distance behind the output rolls of the stretch works of a textile machine, particularly a carding machine. The longitudinal side of the funnel is laterally closed by a baffle plate. The baffle plate borders a bulged impact plates, which, at the deepest part of the bulge possess an outlet opening for the reception of a funnel duct. The impact plates form an intersection line with a ramp located oppositely to the baffle plate. On the impact plate from any optional point of the intersection line, a decline is defined to the exit-opening of the funnel.

18 Claims, 3 Drawing Sheets

FLEECE FUNNEL

FIELD OF THE INVENTION

The invention concerns a fleece funnel, which is placed at a predetermined distance behind exit rolls of a stretch works of a textile machine, the latter being, in particular, a carding machine. One longitudinal side of the fleece funnel is closed off laterally by a baffle plate, and borders a bulged out impact plate. At the deepest part of the bulged impact plate, a boring is provided for the reception of a funnel outlet duct. The impact surface forms an intersection line with a ramp plate opposite to the baffle plate.

BACKGROUND

In the practice, the fleece funnel would also be called a "matting nozzle". For the sake of a consistent terminology, the term "fleece funnel" will be used in the following.

DE 196 18 642 A1 discloses a fleece funnel. The fleece funnel therein described should clearly assure a higher delivery capacity than 900 m/min without interfering with the quality of the fiber band and without disturbance to the fiber band transport.

In the technical development of the stretch machine, an increase of the through-put speed was given high rank as a requirement. To this point, we make a few comments:

As a rule, a plurality of fiber bands are fed to the stretch works of a stretch machine, which are combined into a single fiber band. The tensioning of the doubled fiber band was carried out in a stretch works. The delivery roll-pair is the exit roll-pair of a stretch works and produces a widened out fiber band. The widened fiber band is designated by the expert in the operation as "Fiber matting". This fiber matting is transported into the fleece funnel at a high velocity (>900 m/min). The speed of this delivery is transmitted to the fiber matting by means of the circumferential speed of the delivery roll-pair. The fleece funnel must collect this fiber matting, roll it up, so that the air is expelled from the fiber matting, and divert it to the funnel outlet duct from whence it is discharged.

With the feed of the fiber matting into the receiving opening of the funnel, there arises once more a thickened fiber band. The previous developments concerning such funnels showed widely differing presentations of design.

By means of the high delivery speed (up to 1000 m/min) in the stretch machine, the shape of the fleece funnel intensively occupied the designers. In this activity, it was shown that the fleece funnel, along with other operational organs, played an essential role for the attainment of the desired delivery speed. The fleece funnel must be in such a technological state, that in the case of essentially higher speeds of the transported matting received from the delivery rolls, this matting could be safely rolled out without detracting from the quality, and further transported as a fiber band.

These described fleece funnels were also used on stretch works on which a carding machine had been added. In this case, the evidence showed that the fleece funnel, laid out for high delivery speeds of the fiber band, allowed no automatic entry manipulations to permit a fiber band of a carding machine to enter into the said fleece funnel. The delivery velocity of the fiber band in carding machines runs between 150 m/min to 180 m/min.

SUMMARY OF THE INVENTION

It is the purpose of the invention to design a fleece funnel for a stretch machine in such a manner that the fiber band being delivered from the stretch works be automatically transported into the fleece funnel at a lower speed and without manual intervention. Additional objects and advantages of the invention will be set forth in part in the following description, or may be obvious from the description, or may be learned through practice of the invention.

The invention concerns a fleece funnel, which is placed at a predetermined distance behind exit rolls of the stretch works of a textile machine, the latter being especially, a carding machine. One longitudinal side of the fleece tunnel is closed off laterally by a baffle plate and borders a bulged out impact plate. At the deepest part of the bulged impact plate, a boring is provided for the reception of a funnel outlet duct, and the impact plate forms an intersecting line with a ramp plate located opposite to the baffle plate.

In accord with the invention, from any chosen point of the common line of intersection of the impact plate and the ramp plate, the impact plate exhibits a decline to the discharge of the funnel duct. In other words, the intersection forms an apex line, or a kind of a crest, which is created from both sides, i.e. the ramp plate on one side and the impact plate on the other, each built with a downward slope. By means of the additionally sloped impact plate, the fiber band being delivered from a stretch works, that is the beginning of the fiber band, is guided automatically to the feed opening of the funnel. The insertion of the fiber band is done, in this operation, entirely automatically.

Following the passage of the fiber band start through a (as a rule) closed stretch works, the fiber band start strikes the impact plate and slides, without any assisting manipulation, directly to the exit connection of the funnel, i.e. the funnel duct. The manual guidance of the fiber band into the funnel, employed up to this time, can now be left to automatic means. Upon the start-up of the textile machine, the fiber band is first introduced into a closed stretch works and from the stretch works, automatically directed to the fleece funnel. At this point, in an appropriate manner, the fiber band at its start is somewhat twisted, so that a front running, tapered point is formed. This front running fiber band head enables an additionally easy introduction of the fiber band into the stretch works and into the fleece funnel.

Further, it is advantageous , if between the impact plates and the baffle plates an intersecting line is so formed, that from each point of this line of intersection to the funnel outlet duct, the impact plate is again, likewise provided with a declining aspect. This leads to the situation, that, as a whole, a funnel-like funnel, i.e. a conical shaped funnel impact surface is formed, so that the fiber band start is conducted to the funnel exit duct both from the baffle plate and the bordering impact plate.

In an improvement, the intersecting lines touch one another in such a manner, that they become continuous, that is, take form all around the periphery of the outer rim of the impact plate. By this means, in effect a common intersection line is formed.

An easy sliding of a fiber band is especially assured if the two intersection lines in the common contact points exhibit the same curvature.

Even so, it is possible that the ramp plate side impact plate and the oppositely situated baffle plate, in their common contact line, form a fissure or a groove. Preferably, the transition is to be smooth and without recesses or the like.

The fleece funnel can be made out of one piece, if, a conical or cone shaped funnel-form is made from the peripherally running intersection line to the rim of the outlet duct of the funnel. By means of this shape of the funnel, no edges or rough seams evolve, so the fiber band is particularly well conducted from the side areas of the funnel to the exit duct thereof.

The sliding of the fiber band beginnings, that is, the entire fiber band, is further enhanced by the fact that the impact plate has a smooth and/or exhibits a polished surface. By such smooth surfaces, the friction coefficient and the friction between the fiber band and the impact plate is clearly reduced, whereby the fiber band can be quickly and easily automatically manipulated.

A further improvement of the automatic insertion of the fiber band into the funnel is achieved in that, as seen in a cross-section view, in respective planes perpendicular to the baffle plate, the intersection point proximal to the baffle plate is lower, in relation to the outlet opening of the funnel, than is the corresponding intersection point remote from the baffle plate. This means that the ramp side intersection line is, in general, always, "higher" than is the corresponding intersection on the impact plate. In general, the inclined impact plate on the baffle plate side is bordered by the baffle plate, which rises above the opposite impact surface. When the entering fiber band strikes the baffle plate, then the fiber band will be diverted onto the impact plate and conducted without problem from there into the funnel exit duct as a result of the designed impact plate slope.

Favorable relationships to the automatic, insertion of the fiber band into the funnel arise when the opening angle formed between the longitudinal axis of the funnel outlet duct and the plane of the impact plate surface varies between 10° and 75°. This opening angle assures a reasonable compromise between the funnel like receiving surfaces and the inclination of the surfaces, which, with an increasing opening angle, assure that the friction will be reduced.

If the angle is set at too great a value, then the receiving surface is clearly reduced, whereby the automatic entry is made difficult. When the receiving surface is larger, then the fiber band point is more easily captured. Moreover, on the fleece funnel, advantageously, the opening angle of the impact plates are symmetric to a plane vertical to the longitudinal axis of the funnel exit duct and the baffle plate. In this way, the construction is substantially simplified.

Summarizing, the invention makes possible an easy and reliable insertion of a fiber band point into a fleece funnel. Besides this, the fiber band entry is carried out automatically and without manual help. For the support of the introduction of the fiber band point, a pneumatic suction can be provided. In order to increase the density, or thicken, the fiber band, customarily, the funnel exit diameter is less than the thickness of the fiber band. For the insertion, in any event, the fiber band is provided with a point at its start, that is, as mentioned, by twisting the fiber band. As an alternative fraying or thining out the fiber band is likewise a possibility.

With the aid of the following drawings, embodiments of the invention are more closely described and explained.

DETAILED DESCRIPTION

Reference will now be made in detail to one or more embodiments of the invention detailed in the figures. Each embodiment is presented by way of explanation of the invention, and not meant as a limitation of the invention. For example, features illustrated or described as part of one embodiment may be used with another embodiment to yield still a different embodiment. It is intended that the present invention include such modifications and other variations.

Figure 1:
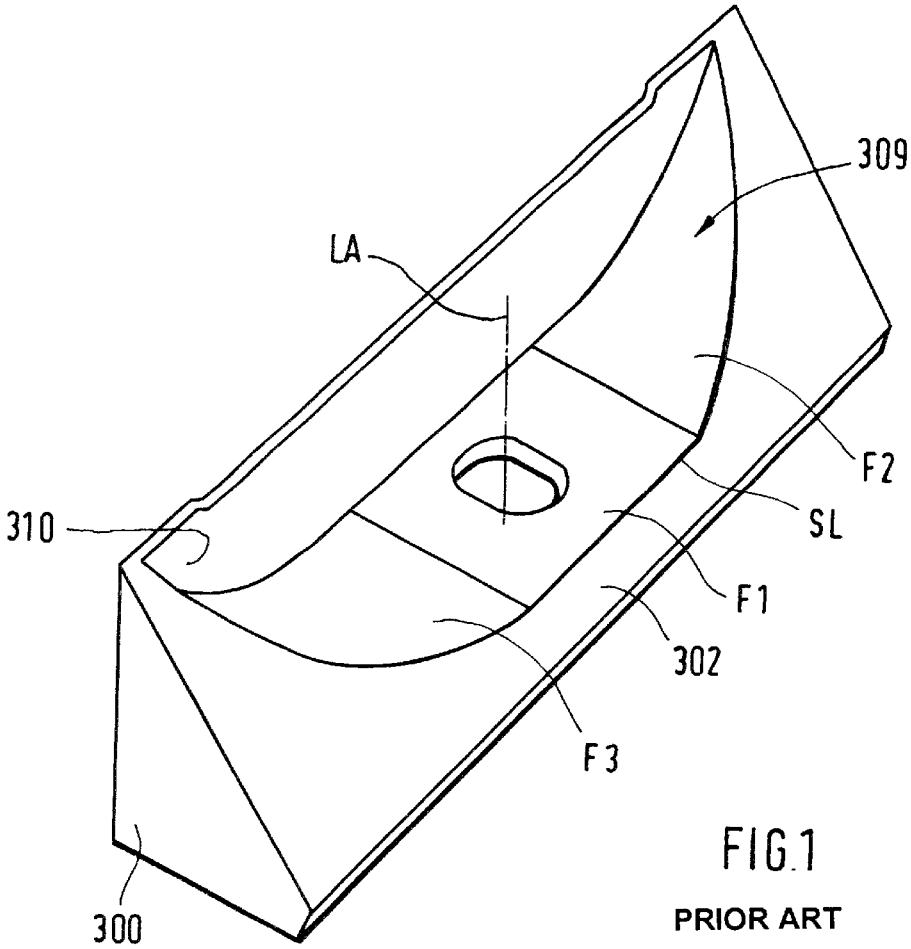
FIG.1 PRIOR ART
FIG. 1 fleece funnel in accord with the state of the technology (DE 196 18 642 A1), FIG. 2 the fleece funnel of FIG. 1 in cross-section, FIG. 3 a fleece funnel in accord with the invention, FIG. 4 a front view of a funnel inset, FIG. 5 a top view of FIG. 4

FIG. 1 depicts the known fleece funnel 300 as disclosed by DE 196 18 642 A1 in a perspective presentation. The fleece funnel 300 possesses an impact plate with three plate 309 sections, F1, F2, F3.

On both sides of the flat plate section F1 are located the curved plate sections F2 and F3. In the middle of the plate section F1, the funnel exit connection is placed, which possesses a longitudinal axis LA.

The impact plate 309 is closed on the longitudinal side by a baffle plate 310, whereby the two plates (baffle plate 309, impact plate 310) enclose an angle of 90° between them. Across from the baffle plate 310 is found an inclined ramp plate 302, which, together with the impact plate 309 has a common line of intersection SL.

Figure 2:
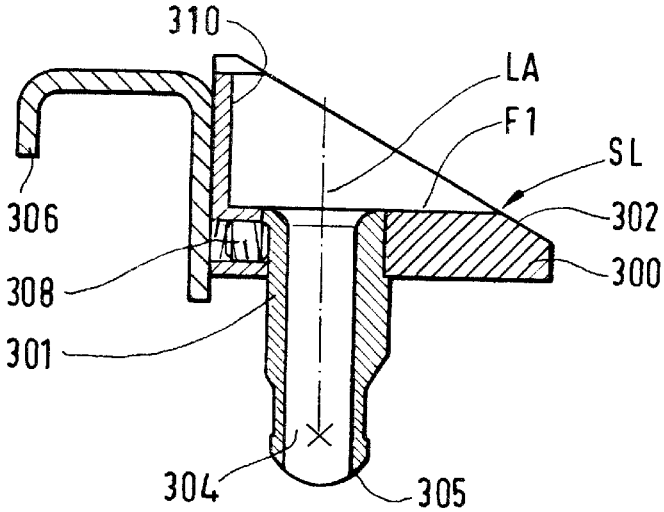
FIG.2 PRIOR ART

FIG. 2 shows, in cross-section, the fleece funnel 300 from FIG. 1. The funnel 300 solves the problem, that the fiber bands carried at a high delivery speed (ca. 1000 m/min) entrain air, which contributes to a swelling of the fiber band before entry into the fleece funnel.

In the outlet opening of the funnel, a nozzle 301 is installed with a duct 304, which is held on the funnel by means of a set screw 308. The end of the nozzle set exhibits a spherical linkage 305, which, in a complementary linkage receiver can form a pivoting connection for the swinging of the funnel 300. Beyond this, a gripping yoke 306 is attached to the funnel 300 for better manual handling.

Figure 3:
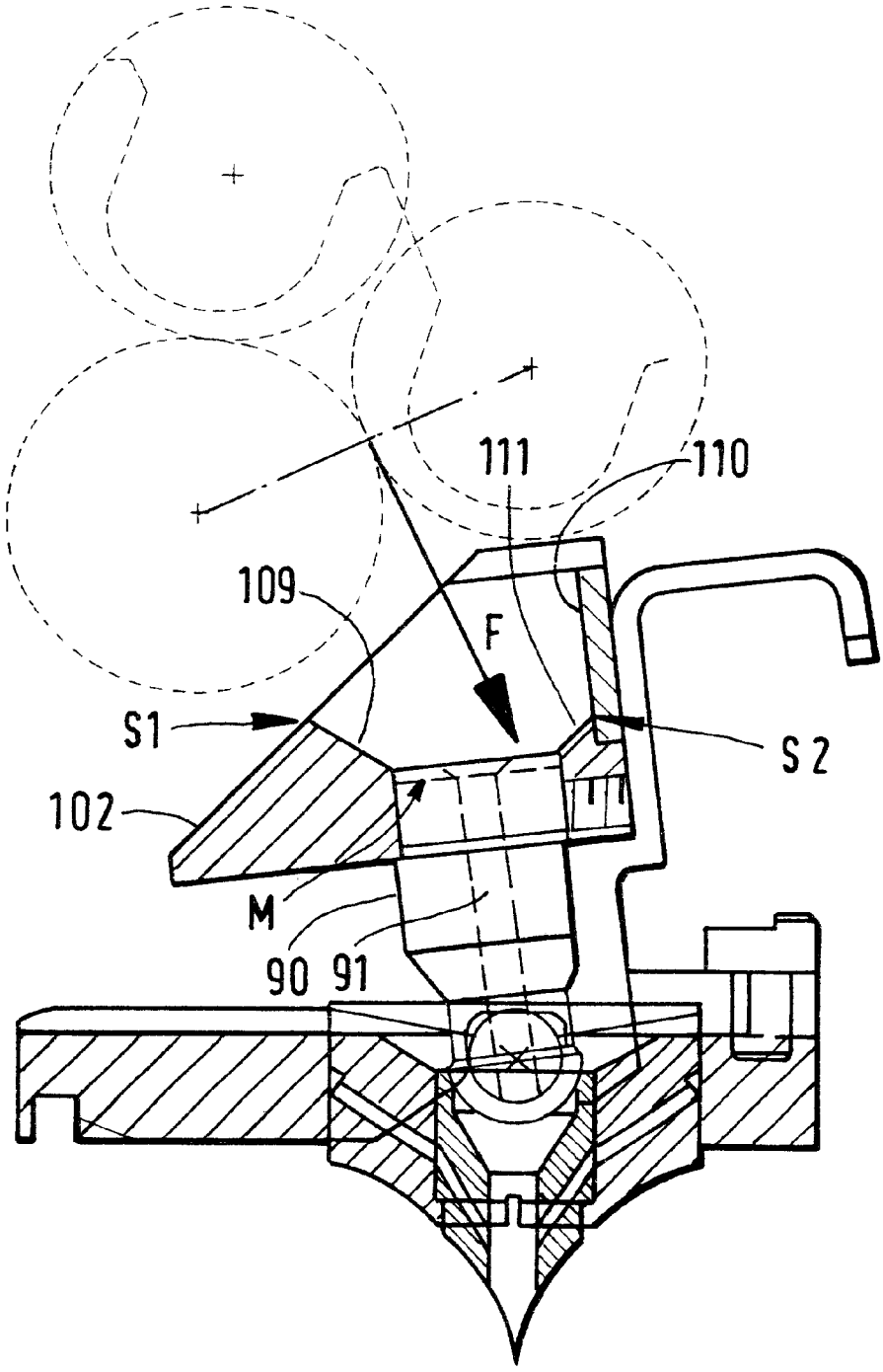

FIG. 3 shows an embodiment of a fleece funnel in accord with the invention. The fleece funnel possesses a ramp 102, inclined outwardly, which, with an inclined impact plate 109 forms an intersecting line SI.

Opposite to the impact plate 109 is placed another inclined impact plate 111 and a baffle plate 110. The baffle plate 110 intersects the inclined impact plate 111.

The inclined impact plates 109, 111 are inclined toward the center of the funnel outlet opening M. In the funnel outlet opening is installed a nozzle set 90 with a duct 91. The fleece funnel is found, in its operative position, underneath a roll arrangement of a closed stretch works. The arrow F clarifies the output direction of fiber band being discharged from the closed stretch works.

When so discharged, the above mentioned fiber band point strikes against the impact plates 109, 111.

Because of the inclination, of these preferably polished surfaces 109, 111, the fiber band continues on into the funnel outlet opening M. Additionally, the fiber band can be pneumatically suctioned off at this outlet opening, whereby the automatic insertion of the fiber band is substantially improved.

The baffle plate 110 and the bordering, inclined impact plates 111 likewise form an intersection line S2. Advantageously, the intersection line S1 is, in elevation, constructed higher than is the intersection line S2, so that the delivered fiber band can be better captured by the more elevated impact plate 109. The baffle plate 110, oppositely situated across from the impact plate 109 serves also for the arresting of the fiber band.

Figure 4:
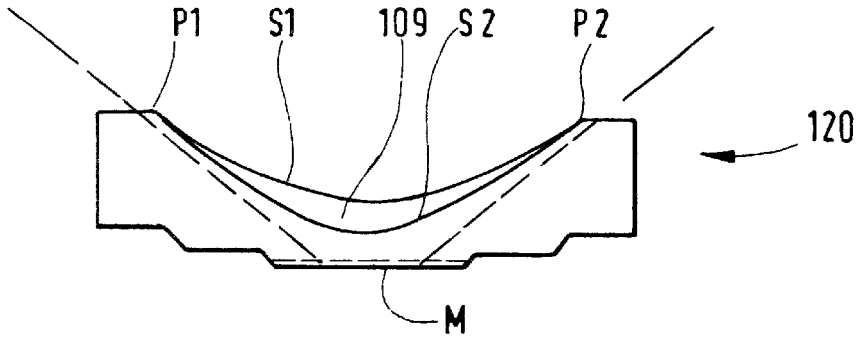

FIG. 4 shows a contour of a funnel unit 120 as seen from the front. The funnel unit 120 possesses two intersection lines, S1, S2, which contact one another in oppositely placed points P1 and P2 which form junctions. The two intersection lines S1, S2 have, in the depicted projection of the front, different curvatures. The forward intersection line S2 closes directly on a baffle plate not shown here. The rear intersection line S1 is created by an inclined impact plate 109 and the likewise inclined ramp.

Figure 5:
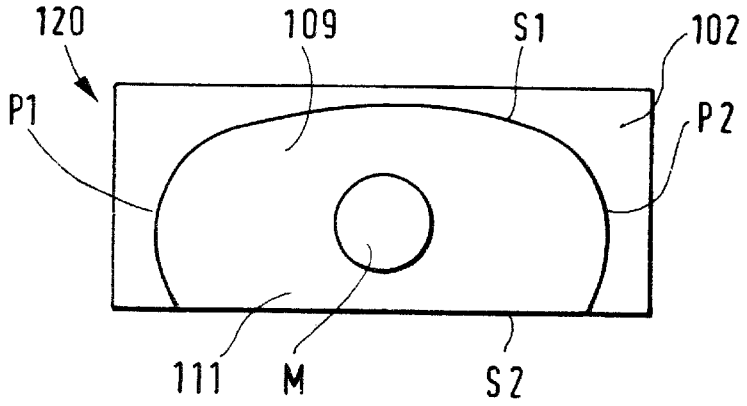

FIG. 5 shows a plan view of the funnel unit 120 of FIG. 4. From this may be inferred, that the intersection line S1 in this projection is likewise curved and transitions directly at points P1 and P2 into the likewise curved intersection line S2. Moreover, the impact surfaces 109 and 111 merge into the two longitudinal sides of the funnel unit 120 at the points P1, P2, so that, as a whole, a funnel-like or conical narrowing is brought about in the funnel unit 120.

Figure 6:
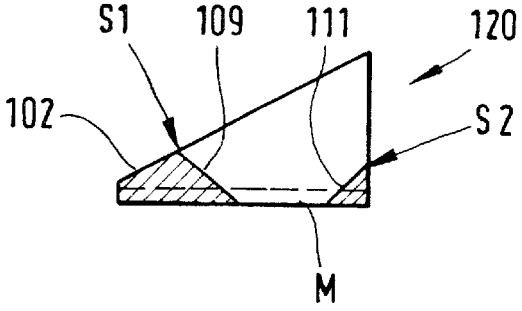
FIG. 6 a cross section through the inset of FIG. 4

FIG. 6 shows the funnel unit of FIGS. 4, 5 in a cross-section. In the funnel outlet opening M, a nozzle assembly will be inserted. The intersection line S1 places a small fill between the two inclined ramp surfaces 102, 109. On the oppositely placed, and likewise inclined impact plate 111, again a fill is provided. Between the impact plate 111 and the baffle plate, the intersection line S2 is formed.

The invention provides the possibility, that the fiber bands from carding machines in a stretch works, which carding machines run at a lower delivery speed (about 150 m/min), can be automatically captured in a fleece funnel after the stretch machine run without manual intervention.

It should be appreciated by those skilled in the art that modifications and variations can be made to the embodiments described herein without departing from the scope and spirit of the appended claims.

What is claimed is:

1. A fleece funnel configured for placement downstream from exit rolls of a textile machine drafting device, said fleece funnel comprising:

a bulged impact surface including a funnel outlet opening defined in a deepest section of said bulged impact surface;

a baffle plate extending generally vertically along a longitudinal side of said impact surface;

a ramped surface extending longitudinally along said impact surface opposite from said baffle plate, said ramped surface angled upwards towards said impact surface and defining a first line of intersection with said impact surface; and wherein said impact surface is inclined such that at any point along said first intersection line, a sloped fiber material conveying surface is defined by said impact surface from said first line of intersection to said outlet opening.

2. The fleece funnel as in claim 1 further comprising a second line of intersection defined where said impact surface meets said baffle plate, said impact surface inclined such that at any point along said second intersection line, a sloped fiber material conveying surface is defined by said impact surface from said second line of intersection to said outlet opening.

3. The fleece funnel as in claim 2, wherein said impact surface comprises at least two impact plates defining a generally continuously sloped surface around said outlet opening.

4. The fleece funnel as in claim 2, wherein said first and second lines of intersection merge with each other so as to define a closed outer peripheral rim of said impact surface.

5. The fleece funnel as in claim 4, wherein said impact surface defines a funnel-shape from said peripheral rim to said outlet opening.

6. The fleece funnel as in claim 2, wherein said second line of intersection is disposed in a plane closer to said outlet opening than a plane of said first line of intersection.

7. The fleece funnel as in claim 1, wherein said fiber material conveying surface of said impact surface is a polished surface.

8. The fleece funnel as in claim 1 wherein said impact surface defines an angle between about 10 to about 75 degrees with a vertical axis through said outlet opening.

9. The fleece funnel as in claim 8, wherein said angle is symmetric with respect to a vertical plane of the longitudinal axis of said outlet opening and parallel to said baffle plate.

10. A textile machine comprising a drafting device having a pair of exit rolls, and a fleece funnel disposed to receive fiber material conveyed from said exit rolls, said fleece funnel further comprising;

a bulged impact surface including a funnel outlet opening a defined in a deepest section of said bulged impact surface;

a baffle plate extending generally vertically along a longitudinal side of said impact surface;

a ramped surface extending longitudinally along said impact surface opposite from said baffle plate, said ramped surface angled upwards towards said impact surface and defining a first line of intersection with said impact surface; and wherein said impact surface is inclined such that at any point along said first intersection line, a sloped fiber material conveying surface is defined by said impact surface from said first line of intersection to said outlet opening.

11. The textile machine as in claim 10, wherein said fleece funnel further comprises a second line of intersection defined where said impact surface meets said baffle plate, said impact surface inclined such that at any point along said second intersection line, a sloped fiber material conveying surface is defined by said impact surface from said second line of intersection to said outlet opening.

12. The textile machine as in claim 11 wherein said impact surface comprises at least two impact plates defining a generally continuously sloped surface around said outlet opening.

13. The textile machine as in claim 11, wherein said first and second lines of intersection merge with each other so as to define a closed outer peripheral rim of said impact surface.

14. The textile machine as in claim 13, wherein said impact surface defines a funnel-shape from said peripheral rim to said outlet opening.

15. The textile machine as in claim 11, wherein said second line of intersection is disposed in a plane closer to said outlet opening than a plane of said first line of intersection.

16. The textile machine as in claim 10, wherein said fiber material conveying surface of said impact surface is a polished surface.

17. The textile machine as in claim 10, wherein said impact surface defines an angle between about 10 to about 75 degrees with a vertical axis through said outlet opening.

18. The textile machine as in claim 17, wherein said angle is symmetric with respect to a vertical plane of the longitudinal axis of said outlet opening and parallel to said baffle plate.

* * * * *